US009639101B2

(12) United States Patent
Suzuki

(10) Patent No.: US 9,639,101 B2
(45) Date of Patent: May 2, 2017

(54) VOLTAGE REGULATOR

(71) Applicant: Seiko Instruments Inc., Chiba-shi, Chiba (JP)

(72) Inventor: Teruo Suzuki, Chiba (JP)

(73) Assignee: SII SEMICONDUCTOR CORPORATION, Chiba-Shi, Chiba (JP)

( * ) Notice: Subject to any disclaimer, the term of this patent is extended or adjusted under 35 U.S.C. 154(b) by 13 days.

(21) Appl. No.: 14/664,361

(22) Filed: Mar. 20, 2015

(65) Prior Publication Data

US 2015/0277458 A1 Oct. 1, 2015

(30) Foreign Application Priority Data

Mar. 25, 2014 (JP) ..... 2014-061699

(51) Int. Cl.

| | |
|---|---|
| ***G05F 1/61*** | (2006.01) |
| ***G05F 1/56*** | (2006.01) |
| ***H02M 3/156*** | (2006.01) |
| ***H02M 3/158*** | (2006.01) |
| ***H02M 3/155*** | (2006.01) |
| ***G05F 1/575*** | (2006.01) |

(52) U.S. Cl.
CPC ..... *G05F 1/56* (2013.01); *G05F 1/575* (2013.01)

(58) Field of Classification Search
CPC .. G05F 1/575; G05F 1/56; G05F 1/61; H02M 3/156; H02M 3/158; H02M 3/1588; H02M 2003/1566; H02M 3/155
USPC ..... 323/280–281
See application file for complete search history.

(56) References Cited

U.S. PATENT DOCUMENTS

| | | | | |
|---|---|---|---|---|
| 6,720,754 | B2 * | 4/2004 | Nakashimo | G05F 1/575 323/282 |
| 7,411,376 | B2 * | 8/2008 | Zhang | G11C 5/147 323/277 |
| 2003/0011952 | A1 * | 1/2003 | Fukui | G05F 1/573 361/93.1 |
| 2005/0231180 | A1 * | 10/2005 | Nagata | G05F 1/575 323/268 |
| 2008/0265853 | A1 * | 10/2008 | Chen | G05F 1/571 323/280 |
| 2009/0045870 | A1 * | 2/2009 | Imura | G05F 1/56 327/543 |

(Continued)

FOREIGN PATENT DOCUMENTS

JP 5-127763 A 5/1993

*Primary Examiner* — Timothy J Dole
*Assistant Examiner* — Sisay G Tiku
(74) *Attorney, Agent, or Firm* — Brinks Gilson & Lione

(57) ABSTRACT

To provide a voltage regulator capable of maintaining the accuracy of an output voltage even if it is set to an arbitrary output voltage. A voltage regulator includes an output transistor comprised of an NMOS transistor having a backgate grounded, an error amplifier circuit configured to amplify and output a difference between a divided voltage obtained by dividing an output voltage outputted from the output transistor and a reference voltage and thereby to control a gate of the output transistor, a constant voltage circuit, and a transistor having a gate inputted with a voltage of the constant voltage circuit, a drain connected to the gate of the output transistor, and a source connected to a source of the output transistor.

2 Claims, 2 Drawing Sheets

(56) References Cited

U.S. PATENT DOCUMENTS

| | | | | |
|---|---|---|---|---|
| 2009/0179622 | A1* | 7/2009 | Ivanov | G05F 1/575 323/271 |
| 2010/0207591 | A1* | 8/2010 | Imura | G05F 1/565 323/265 |
| 2010/0213909 | A1* | 8/2010 | Nakashimo | G05F 1/5735 323/282 |
| 2012/0194147 | A1* | 8/2012 | Socheat | G05F 1/575 323/265 |
| 2013/0069607 | A1* | 3/2013 | Suzuki | G05F 1/575 323/271 |
| 2014/0253068 | A1* | 9/2014 | Utsunomiya | G05F 1/56 323/273 |
| 2014/0253069 | A1* | 9/2014 | Utsunomiya | G05F 1/565 323/273 |
| 2015/0055257 | A1* | 2/2015 | Azuma | H02H 9/025 361/18 |
| 2015/0168970 | A1* | 6/2015 | Tomioka | G05F 1/567 323/280 |
| 2015/0205315 | A1* | 7/2015 | Tomioka | G05F 1/56 323/280 |

* cited by examiner

VOLTAGE REGULATOR

RELATED APPLICATIONS

This application claims priority under 35 U.S.C. §119 to Japanese Patent Application No. 2014-061699 filed on Mar. 25, 2014, the entire contents of which is hereby incorporated by reference.

BACKGROUND OF THE INVENTION

Field of the Invention

The present invention relates to a voltage regulator configured to generate a constant output voltage Vout in response to an input voltage, and more specifically to output voltage accuracy of the voltage regulator.

Background Art

Generally, a voltage regulator generates a constant output voltage Vout at an output terminal in response to a power supply voltage VDD. The voltage regulator supplies current according to a load fluctuation and always keeps the output voltage Vout constant.

FIG. 4 is a circuit diagram of a related art voltage regulator. The related art voltage regulator is equipped with a reference voltage circuit 103, an error amplifier 104, an NMOS transistor 109, resistors 105 and 106, a capacitor 301, a power supply terminal 101, a ground terminal 100, and an output terminal 102.

When a reference voltage Vref of the reference voltage circuit 103 is larger than a divided voltage Vfb obtained by dividing an output voltage Vout of the output terminal 102 by the resistors 105 and 106, the output of the error amplifier 104 becomes high to reduce an on resistance of the NMOS transistor 109. Further, the voltage regulator is operated so as to raise the output voltage Vout and equalize the divided voltage Vfb and the reference voltage Vref to each other. When the reference voltage Vref is smaller than the divided voltage Vfb, the output of the error amplifier 104 becomes low to make high the on resistance of the NMOS transistor 109. Further, the voltage regulator is operated so as to reduce the output voltage Vout and equalize the divided voltage Vfb and the reference voltage Vref to each other.

The voltage regulator always keeps the divided voltage Vfb and the reference voltage Vref equally and thereby generates a constant output voltage Vout (refer to, for example, FIG. 5 in Patent Document 1)

[Patent Document 1]

Japanese Patent Application Laid-Open No. Hei 5 (1993)-127763

SUMMARY OF THE INVENTION

The related art voltage regulator is, however, accompanied by a problem that when a substrate potential of the NMOS transistor 109 is grounded, a threshold voltage of the NMOS transistor 109 changes by a substrate effect before and after trimming of the resistors 105 and 106, so that the accuracy of the output voltage Vout cannot be ensured.

The present invention has been made in view of the above problems and provides a voltage regulator configured to maintain the accuracy of an output voltage even if it is set to an arbitrary output voltage.

In order to solve the related art problems, one aspect of a voltage regulator of the present invention is configured as follows:

The voltage regulator includes an output transistor comprised of an NMOS transistor having a backgate grounded, and an error amplifier circuit configured to amplify and output a difference between a divided voltage obtained by dividing an output voltage outputted from the output transistor and a reference voltage and thereby to control a gate of the output transistor. The voltage regulator is provided with a constant voltage circuit, and a transistor having a gate inputted with a voltage of the constant voltage circuit, a drain connected to a gate of the output transistor, and a source connected to a source of the output transistor.

It is possible to suppress a change in the threshold of an output transistor before and after trimming and maintain the accuracy of an output voltage even if it is set to an arbitrary output voltage.

DESCRIPTION OF THE PREFERRED EMBODIMENTS

Voltage regulators of the present invention will hereinafter be described with reference to the accompanying drawings.

<First Embodiment>

Figure 1:
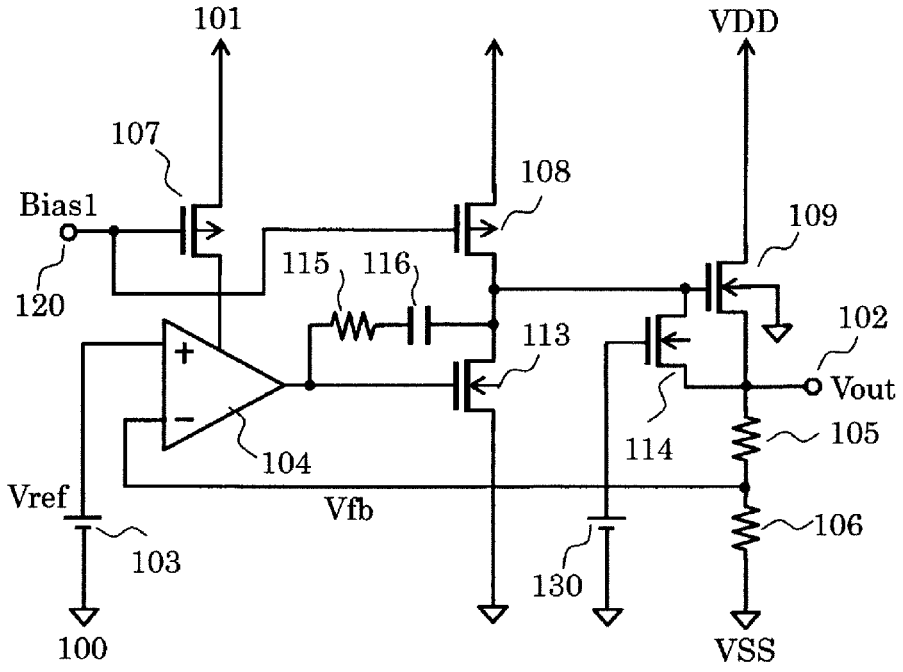
FIG. 1 is a circuit diagram of a voltage regulator according to a first embodiment.

FIG. 1 is a circuit diagram of a voltage regulator according to a first embodiment.

The voltage regulator according to the first embodiment is equipped with a reference voltage circuit 103, an error amplifier 104, NMOS transistors 109, 113 and 114, PMOS transistors 107 and 108, resistors 105, 106 and 115, a capacitor 116, a constant voltage circuit 130, a power supply terminal 101, a ground terminal 100, an output terminal 102, and an input terminal 120.

The error amplifier 104, the NMOS transistor 113, the PMOS transistors 107 and 108, the resistor 115 and the capacitor 116 configure an error amplifier circuit having a two-stage configuration. Further, the resistor 115 and the capacitor 116 configure a phase compensation circuit.

A description will be made about the connections of the voltage regulator according to the first embodiment. The error amplifier 104 has a non-inversion input terminal to which a positive electrode of the reference voltage circuit 103 is connected, an inversion input terminal to which a connecting point of the resistors 105 and 106 is connected, and an output terminal connected to a gate of the NMOS transistor 113. The PMOS transistor 107 has a drain connected to the error amplifier 104 as a current source. A negative electrode of the reference voltage circuit 103 is connected to the ground terminal 100. The other terminal of the resistor 106 is connected to the ground terminal 100, and the other terminal of the resistor 105 is connected to the output terminal 102. The PMOS transistor 107 has a gate connected to the input terminal 120, and a source connected to the power supply terminal 101. The NMOS transistor 113 has a drain connected to one terminal of the capacitor 116, and a source connected to the ground terminal 100. The resistor 115 has one terminal connected to the other terminal of the capacitor 116, and the other terminal connected to the output terminal of the error amplifier 104.

The PMOS transistor 108 has a gate connected to the input terminal 120, a drain connected to the drain of the NMOS transistor 113, and a source connected to the power supply terminal 101. The NMOS transistor 109 has a gate connected to the drain of the NMOS transistor 113, a drain connected to the power supply terminal 101, a source connected to the output terminal 102, and a backgate connected to the ground terminal 100. The NMOS transistor 114 has a gate connected to a positive electrode of the constant voltage circuit 130, a source connected to the output terminal 102, and a drain connected to the gate of the NMOS transistor 109. A negative electrode of the constant voltage circuit 130 is connected to the ground terminal 100.

A description will next be made about the operation of the voltage regulator according to the first embodiment. When a power supply voltage VDD is inputted to the power supply terminal 101, the voltage regulator outputs an output voltage Vout from the output terminal 102. The resistors 105 and 106 divide the output voltage Vout and output a divided voltage Vfb. The error amplifier 104 compares a reference voltage Vref of the reference voltage circuit 103 and the divided voltage Vfb and controls a gate voltage of the NMOS transistor 109 operated as an output transistor, through the NMOS transistor 113 in such a manner that the output voltage Vout becomes constant. The input terminal 120 is connected to a bias circuit although not illustrated in the figure, and allows a bias current to flow in the error amplifier 104 and the NMOS transistor 113 through the PMOS transistor 107 and the PMOS transistor 108.

In order to set the output voltage Vout to an arbitrary value, the output voltage Vout is measured after the input of the power supply voltage VDD, and the resistors 105 and 106 are trimmed on the basis of the output voltage Vout to adjust their resistance values, thereby making it possible to generate the arbitrary output voltage Vout. When the output voltage Vout is set to a low voltage, a source voltage of the NMOS transistor 114 becomes low as compared with before the trimming. Further, since a constant voltage independent on the output voltage Vout is inputted to the gate of the NMOS transistor 114, a drain current of the NMOS transistor 114 is increased so that the gate voltage of the NMOS transistor 109 is lowered. Since the backgate of the NMOS transistor 109 is grounded, the threshold voltage of the NMOS transistor 109 is also lowered with the reduction in the gate voltage, and the threshold of the NMOS transistor 109, which has fluctuated before and after the trimming can hence be restored. Thus, since it is possible to suppress a change in the threshold of the NMOS transistor 109 before and after the trimming, the accuracy of the output voltage Vout can be maintained.

When the output voltage Vout is set to a high voltage, the source voltage of the NMOS transistor 114 also becomes high as compared with before the trimming. Further, since the constant voltage independent on the output voltage Vout is inputted to the gate of the NMOS transistor 114, the drain current of the NMOS transistor 114 is reduced so that the gate voltage of the NMOS transistor 109 is raised. Since the backgate of the NMOS transistor 109 is grounded, the threshold voltage of the NMOS transistor 109 is increased with the rise in the gate voltage, and the threshold of the NMOS transistor 109, which has fluctuated before and after the trimming, can hence be restored. Thus, since it is possible to suppress a change in the threshold of the NMOS transistor 109 before and after the trimming, the accuracy of the output voltage Vout can be maintained.

Incidentally, although the voltage regulator according to the first embodiment has been described using the error amplifier circuit having the two-stage configuration, it is not limited to this configuration. Any configuration may be adopted if there is provided an error amplifier circuit which controls an output transistor.

As described above, the voltage regulator according to the first embodiment is capable of suppressing the change in the threshold of the output transistor before and after the trimming and holding the accuracy of the output voltage even though it is set to the arbitrary output voltage.

<Second Embodiment>

Figure 2:
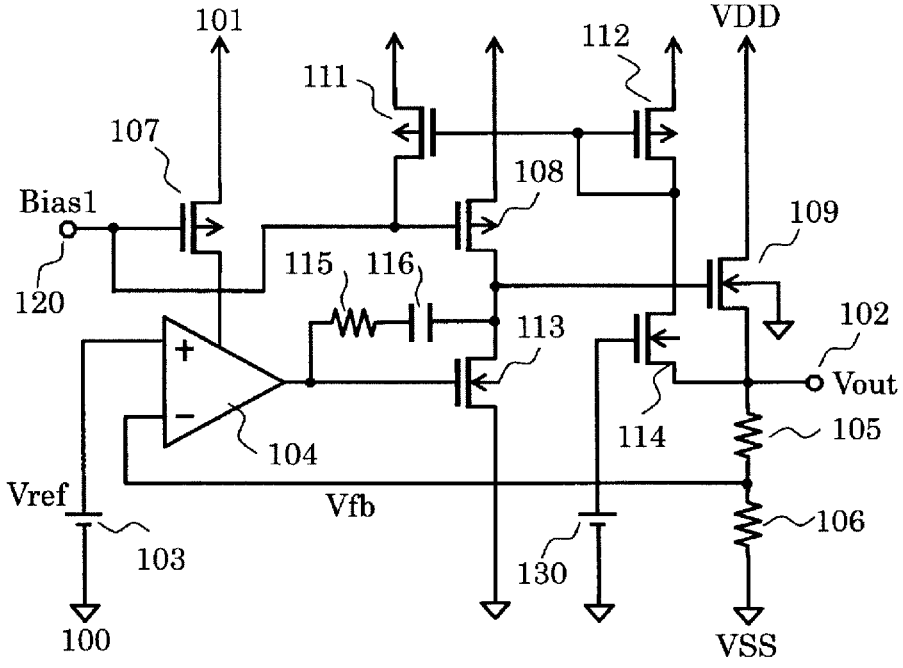
FIG. 2 is a circuit diagram of a voltage regulator according to a second embodiment.

FIG. 2 is a circuit diagram of a voltage regulator according to a second embodiment. A difference from the first embodiment resides in that PMOS transistors 111 and 112 are added and the drain of the NMOS transistor 114 is connected to a gate and drain of the PMOS transistor 112.

The PMOS transistor 111 has a drain connected to the gate of the PMOS transistor 108, a gate connected to the gate and drain of the PMOS transistor 112, and a source connected to the power supply terminal 101. A source of the PMOS transistor 112 is connected to the power supply terminal 101. Others are similar to those in the first embodiment.

A description will be made about the operation of the voltage regulator according to the second embodiment. In order to set an output voltage Vout to an arbitrary value, an output voltage is measured after the input of the power supply voltage VDD, and the resistors 105 and 106 are trimmed on the basis of the output voltage to adjust their resistance values, thereby making it possible to generate an arbitrary output voltage Vout. When the output voltage Vout is set to a low voltage, a source voltage of the NMOS transistor 114 also becomes low as compared with before the trimming. Further, since a constant voltage independent on the output voltage Vout is inputted to the gate of the NMOS transistor 114, a drain current of the NMOS transistor 114 is increased. Since the PMOS transistors 112 and 111 configure a current mirror circuit, an on resistance of the PMOS transistor 111 becomes small in response to the drain current of the NMOS transistor 114, thereby approximating a gate voltage of the PMOS transistor 108 to the power supply voltage VDD. Thus, an on resistance of the PMOS transistor 108 becomes large to reduce a gate voltage of the NMOS transistor 109. Since the backgate of the NMOS transistor 109 is grounded, a threshold voltage of the NMOS transistor 109 is also lowered with the reduction in the gate voltage, and the threshold of the NMOS transistor 109, which has fluctuated before and after the trimming, can hence be restored. Thus, since it is possible to suppress a change in the threshold of the NMOS transistor 109 before and after the trimming, the accuracy of the output voltage Vout can be maintained.

When the output voltage Vout is set to a high voltage, the source voltage of the NMOS transistor 114 also becomes high as compared with before the trimming. Further, since the constant voltage independent on the output voltage Vout is inputted to the gate of the NMOS transistor 114, the drain current of the NMOS transistor 114 is reduced. Since the PMOS transistors 112 and 111 configure a current mirror circuit, the on resistance of the PMOS transistor 111 becomes large in response to the drain current of the NMOS transistor 114, and the gate voltage of the PMOS transistor 108 is lowered to reduce the on resistance of the PMOS transistor 108. Thus, the gate voltage of the NMOS transistor 109 is raised. Since the backgate of the NMOS transistor 109 is grounded, the threshold voltage of the NMOS transistor 109 is increased with the rise in the gate voltage, thereby making it possible to restore the threshold of the NMOS transistor 109 before and after the trimming. Thus, since it is possible to suppress a change in the threshold of the NMOS transistor 109 before and after the trimming, the accuracy of the output voltage Vout can be maintained.

As described above, the voltage regulator according to the second embodiment is capable of suppressing the change in the threshold of the output transistor before and after the trimming and maintaining the accuracy of the output voltage even though it is set to the arbitrary output voltage.

<Third Embodiment>

Figure 3:
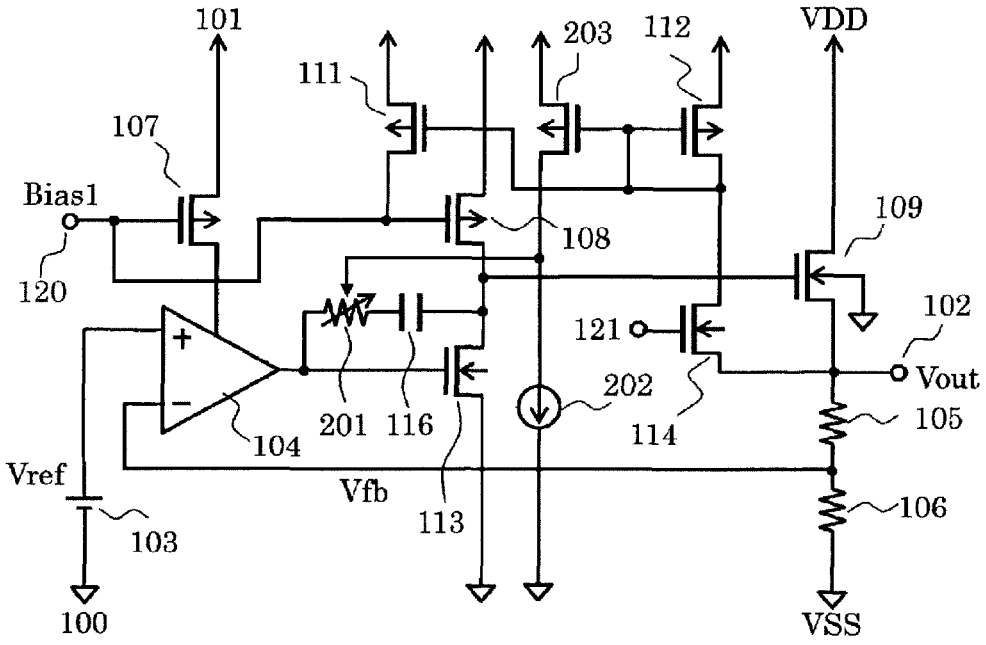
FIG. 3 is a circuit diagram of a voltage regulator according to a third embodiment.
Figure 4:
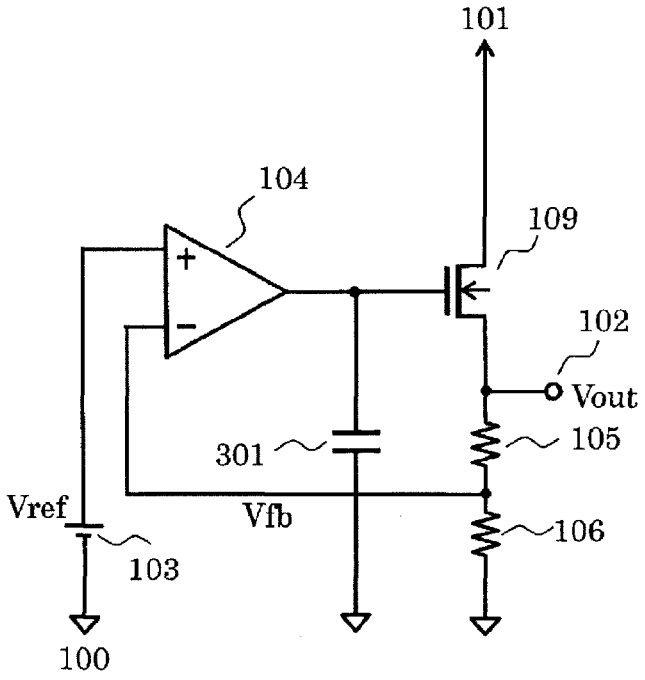
FIG. 4 PRIOR ART
FIG. 4 is a circuit diagram of a related art voltage regulator.

FIG. 3 is a circuit diagram of a voltage regulator according to a third embodiment. A difference from the second embodiment resides in that the resistor 115 is changed to a resistor 201, and a PMOS transistor 203 and a constant current circuit 202 are added.

The PMOS transistor 203 has a gate connected to the gate and drain of the PMOS transistor 112, a drain connected to the constant current circuit 202, and a source connected to the power supply terminal 101. The other terminal of the constant current circuit 202 is connected to the ground terminal 100. The resistor 201 has a resistance value controlled by a voltage at a connecting point of the drain of the PMOS transistor 203 and the constant current circuit 202. Others are similar to those in the second embodiment.

A description will be made about the operation of the voltage regulator according to the third embodiment. In order to set an output voltage Vout to an arbitrary value, an output voltage is measured after the input of the power supply voltage VDD, and the resistors 105 and 106 are trimmed on the basis of the output voltage to adjust their resistance values, thereby making it possible to generate an arbitrary output voltage Vout. When the output voltage Vout is set to a low voltage, the source voltage of the NMOS transistor 114 is also lowered as compared with before the trimming. Further, since a constant voltage independent on the output voltage Vout is inputted to the gate of the NMOS transistor 114, the drain current of the NMOS transistor 114 is increased. Since the PMOS transistors 112 and 111 configure a current mirror circuit, the on resistance of the PMOS transistor 111 becomes small in response to the drain current of the NMOS transistor 114, thus approximating the gate voltage of the PMOS transistor 108 to the power supply voltage VDD. Thus, the on resistance of the PMOS transistor 108 becomes large to lower the gate voltage of the NMOS transistor 109. Since the backgate of the NMOS transistor 109 is grounded, the threshold voltage of the NMOS transistor 109 is also lowered with the reduction in the gate voltage, and the threshold of the NMOS transistor 109, which has fluctuated before and after the trimming, can be restored.

Since the PMOS transistors 203 and 112 configure a current mirror circuit, a drain current of the PMOS transistor 203 also increases in response to the increase in the drain current of the NMOS transistor 114. When the drain current thereof exceeds the current of the constant current circuit 202, the resistance value of the resistor 201 is switched. Thus, it is possible to change the frequency of a zero point for phase compensation determined by the resistors 201 and 116, improve stability of the voltage regulator, and enhance the accuracy of the output voltage Vout.

Thus, it is possible to maintain the accuracy of the output voltage Vout by suppressing a change in the threshold of the NMOS transistor 109 before and after the trimming and improve the accuracy of the output voltage Vout by changing the zero-point frequency.

When the output voltage Vout is set to a high voltage, the source voltage of the NMOS transistor 114 also becomes high as compared with before the trimming. Further, since the constant voltage independent on the output voltage Vout is inputted to the gate of the NMOS transistor 114, the drain current of the NMOS transistor 114 is reduced and the gate voltage of the NMOS transistor 109 is raised. Since the backgate of the NMOS transistor 109 is grounded, the threshold voltage of the NMOS transistor 109 is increased with the rise in the gate voltage, and the threshold of the NMOS transistor 109, which has fluctuated before and after the trimming, can be restored.

Since the PMOS transistors 203 and 112 configure a current mirror circuit, the drain current of the PMOS transistor 203 also decreases in response to the decrease in the drain current of the NMOS transistor 114. When the drain current thereof falls below the current of the constant current circuit 202, the resistance value of the resistor 201 is switched. Thus, it is possible to change the frequency of a zero point for phase compensation determined by the resistor 201 and the capacitor 116, improve stability of the voltage regulator, and enhance the accuracy of the output voltage Vout.

Thus, it is possible to maintain the accuracy of the output voltage Vout by suppressing the change in the threshold of the NMOS transistor 109 before and after the trimming and improve the accuracy of the output voltage Vout by changing the zero-point frequency.

As described above, the voltage regulator according to the third embodiment is capable of suppressing the change in the threshold of the output transistor before and after the trimming and maintaining the accuracy of the output voltage even though it is set to the arbitrary output voltage. Further, it is possible to improve the accuracy of the output voltage Vout by changing the zero-point frequency.

What is claimed is:

1. A voltage regulator comprising an output transistor comprised of an NMOS transistor having a backgate grounded, and an error amplifier circuit having a first amplification stage inputted with a divided voltage obtained by dividing an output voltage outputted from the output transistor and a reference voltage, a second amplification stage configured to control the output transistor, and a first transistor of the second amplification stage configured to allow a separately supplied bias current to flow at an input of the first transistor and a drain of the first transistor subsequently bias a gate of the output transistor, said voltage regulator comprising:

a constant voltage circuit;

a second transistor having a gate inputted with a voltage of the constant voltage circuit and a source connected to a source of the output transistor; and a current mirror circuit having an input connected to a drain of the second transistor, and an output connected to a gate of the first transistor.

2. The voltage regulator according to claim 1, further including:

a third transistor of the current mirror circuit having a gate connected to the drain of the second transistor, and a constant current circuit connected to a drain of the third transistor, wherein a phase compensation circuit of the error amplifier circuit is adjusted by a voltage at a connecting point of the drain of the third transistor and the constant current circuit.

* * * * *